US009521934B1

(12) United States Patent
Ebrahimi Afrouzi et al.

(10) Patent No.: US 9,521,934 B1
(45) Date of Patent: Dec. 20, 2016

(54) CYLINDRICAL ROBOTIC VACUUM

(71) Applicants: Ali Ebrahimi Afrouzi, San Jose, CA (US); Soroush Mehrnia, Copenhagen (DK); Amin Ebrahimi Afrouzi, Berkeley, CA (US); Masih Ebrahimi Afrouzi, Berkeley, CA (US); Azadeh Afshar Bakooshli, San Jose, CA (US)

(72) Inventors: Ali Ebrahimi Afrouzi, San Jose, CA (US); Soroush Mehrnia, Copenhagen (DK); Amin Ebrahimi Afrouzi, Berkeley, CA (US); Masih Ebrahimi Afrouzi, Berkeley, CA (US); Azadeh Afshar Bakooshli, San Jose, CA (US)

(73) Assignee: Bobsweep Inc., Toronto (CA)

( * ) Notice: Subject to any disclaimer, the term of this patent is extended or adjusted under 35 U.S.C. 154(b) by 0 days.

(21) Appl. No.: 14/874,308

(22) Filed: Oct. 2, 2015

Related U.S. Application Data

(60) Provisional application No. 62/060,669, filed on Oct. 7, 2014.

(51) Int. Cl.
*A47L 9/28* (2006.01)
*A47L 5/22* (2006.01)
*A47L 9/00* (2006.01)

(52) U.S. Cl.
CPC ..... *A47L 5/22* (2013.01); *A47L 9/009* (2013.01); *A47L 9/2805* (2013.01); *A47L 9/2836* (2013.01); *A47L 2201/00* (2013.01)

(58) Field of Classification Search
CPC ..... A47L 2201/00; A47L 5/22; A47L 9/009; A47L 9/2805; A47L 9/2836
IPC ..... A47L 9/28
See application file for complete search history.

(56) References Cited

U.S. PATENT DOCUMENTS 5,500,174 A * 3/1996 Scott ..... B01D 29/111 264/112
5,940,927 A * 8/1999 Haegermarck ..... A47L 5/30 15/319
6,883,201 B2 * 4/2005 Jones ..... A47L 5/30 15/319
7,474,941 B2 * 1/2009 Kim ..... A47L 9/009 15/319
7,937,800 B2 * 5/2011 Yan ..... A47L 9/009 15/319
8,209,053 B2 * 6/2012 Kim ..... A47L 9/009 15/319
8,671,507 B2 * 3/2014 Jones ..... A47L 5/30 15/319

* cited by examiner

*Primary Examiner* — David Redding

(57) ABSTRACT

A robotic vacuum wherein the housing of the system is cylindrical in form with two wheels of diameter larger than the diameter of the housing supporting the housing on either end. Larger wheels permit the device to more easily travel over small bumps or obstacles and changes in elevation. Furthermore, the design requires less power to drive the housing, so more energy is available for the primary function of vacuuming.

8 Claims, 1 Drawing Sheet

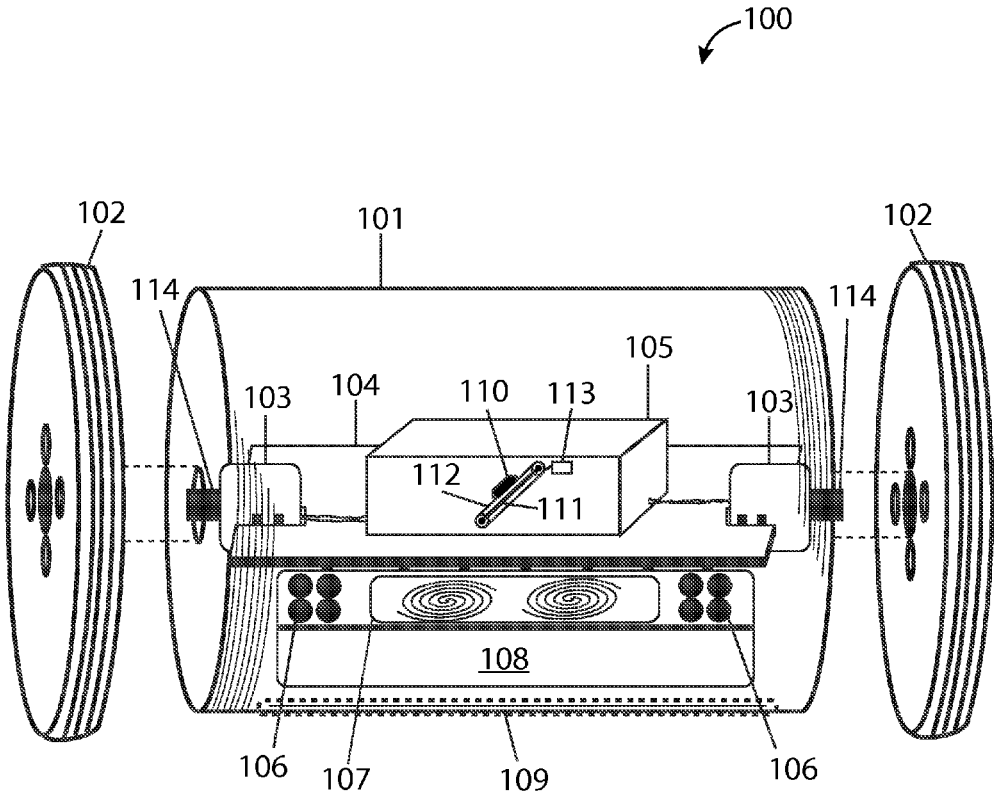
100
102
101
102
114
114
105
103
104
110
113
103
112
111
108
106
107
109
106

CYLINDRICAL ROBOTIC VACUUM

CROSS-REFERENCE TO RELATED APPLICATIONS

This application claims the benefit of provisional patent application Ser. No. 62/060,669, filed Oct. 7, 2014 by the first named inventor.

FIELD OF INVENTION

The present invention relates to the functional design for automated robotic vacuums.

BACKGROUND OF INVENTION

The following is a tabulation of some prior art that presently appears relevant:

U.S. Patent Documents

| Pat. No. | Kind Code | Issue Date | Patentee |
|---|---|---|---|
| 6,883,201 | B2 | Apr. 26, 2005 | Irobot Corporation |
| 5,940,927 | A | Aug. 24, 1999 | Aktiebolaget Electrolux |
| 8,671,507 | B2 | Mar. 18, 2014 | Irobot Corporation |
| 7,474,941 | B2 | Jul. 24, 2003 | Samsung Gwangju Electronics Co., Ltd. |
| 7,937,800 | B2 | May 10, 2011 | Jason Yan |
| 8,209,053 | B2 | Jun. 26, 2012 | Samsung Electronics Co., Ltd. |

Various designs have been invented for robotic vacuums that aim to improve performance and decrease maintenance and cost. One difficulty for many robotic vacuums is overcoming obstacles on work surfaces or traveling across small changes in elevation. One solution is to increase the size of the wheels of a robotic vacuum to increase its driving power.

A need exists for a robotic vacuuming with increased ability to travel over obstacles and throughout all work surfaces with minimal user intervention.

Another challenge in designing robotic vacuums is reducing energy consumption. A need exists for a more energy efficient design for a robotic vacuum.

SUMMARY OF INVENTION

It is a goal of the present invention to provide a design for a robotic vacuum that is more capable of overcoming bumps and obstacles without user intervention.

It is a goal of the present invention to increase the autonomy of a robotic vacuum.

It is a goal of the present invention to provide a design for a robotic vacuum that requires less energy to drive through a work environment.

The present invention achieves the aforementioned goals through a cylindrical design for a robotic vacuum. A cylindrical or tube-shaped body is driven by wheels of diameter larger than the diameter of the tube. The wheels are provided on either end of the tube. Larger wheels give the device more power to travel over bumps and obstacles. Furthermore, the larger wheels aid the driving process and less energy is required to move the device. More energy is thus available for the primary function of vacuuming.

The tube body houses the internal components of the device, including a counterweight that is controlled by a servomotor and gyroscope to maintain the balance of the device. Steering is controlled by adjusting the rate of rotation of the wheels. An opening in the casing of the device allows debris from outside to be vacuumed into the dustbin.

BRIEF DESCRIPTION OF DRAWING

The FIGURE illustrates a robotic vacuum with a cylindrical housing and two large wheels embodying features of the present invention.

DETAILED DESCRIPTION OF THE INVENTION

The present invention will now be described in detail with reference to a preferred embodiment thereof as illustrated in the accompanying drawing. In the following description, numerous specific details are set forth in order to provide a thorough understanding of the present invention. It will be apparent, however, to one skilled in the art, that the present invention may be practiced without some or all of these specific details. In other instances, well known process steps and/or structures have not been described in detail in order to not unnecessarily obscure the present invention.

It should be kept in mind that the invention might also cover articles of manufacture that includes a computer readable medium on which computer-readable instructions for carrying out embodiments of the inventive technique are stored. The computer readable medium may include, for example, semiconductor, magnetic, opto-magnetic, optical, or other forms of computer readable medium for storing computer readable code. Further, the invention may also cover apparatuses for practicing embodiments of the invention. Such apparatus may include circuits, dedicated and/or programmable, to carry out tasks pertaining to embodiments of the invention. Examples of such apparatus include a general-purpose computer and/or a dedicated computing device when appropriately programmed and may include a combination of a computer/computing device and dedicated/programmable circuits adapted for the various tasks pertaining to embodiments of the invention. The disclosure described herein is directed generally to the functional structure and housing of a robotic vacuum.

As understood herein, the term "robotic vacuum" may be defined generally to include one or more autonomous devices having communication, mobility, suction and/or processing elements. For example, a robotic vacuum may comprise a casing or shell, a chassis including a set of wheels, a motor to drive wheels, a receiver that acquires signals transmitted from, for example, a transmitting beacon, a processor, and/or controller that processes and/or controls motor and other robotic autonomous or cleaning operations, network or wireless communications, power management, etc., one or more clock or synchronizing devices, a vacuum motor to provide suction, a debris dustbin to store debris, a brush to facilitate collection of debris, and a means to spin the brush.

The present invention proposes a robotic vacuum with a cylindrical housing with large wheels on either end. Referring to the FIGURE, a robotic vacuum 100 is illustrated. A cylindrical housing 101 is supported by wheels 102 on either end. The wheels are of diameter larger than that of the cylindrical housing. The wheels are connected by bearings 114 to an axle 104 provided through the center of the cylindrical housing. Each wheel is driven by an electric motor 103, which may also be mounted on the axle. The axle may also anchor other internal components. In the example shown, an electronics package 105 is anchored to the axle. An electronics package may comprise any of: a control system, central processing unit, and various sensors. These components are well known in the art and are not part of the claimed invention, so detailed descriptions thereof are not provided. In the preferred embodiment, a balance system comprising one or more counterweights 110, a rod 111 on which to move counterweights, a belt 112 for moving the counterweights along the rod, and a servomotor 113 to power movement of the counterweights is also provided to maintain the housing in an upright position with the opening oriented toward the work surface. In the example shown, these components are provided within the electronics package. In some embodiments, the balance system further comprises a gyroscope sensor to provide more precise calculations for direction of the counterweights. In some embodiments, other robotic vacuum components may also be connected to the axle. In this example, batteries 106, a vacuuming motor 107, and a dustbin 108 are connected to the axle. In the preferred embodiment, robotic vacuum components are installed under the axle to lower the center of gravity of the housing and improve stability. Debris may enter the dustbin through an opening 109 in the housing. The housing may be driven forward by turning both wheels at an equal rate. The housing may be driven toward one side or the other by rotating one wheel at a rate faster than the other.

We claim:

1. A robotic vacuum comprising:

a laterally-oriented cylindrical housing with one or more openings on the underside thereof to allow debris to enter the housing;

a set of wheels of diameter larger than the diameter of said cylindrical housing, each wheel provided at the distal ends of the cylindrical housing;

a set of motors to turn said wheels;

an axle to support said wheels;

bearings to connect said wheels to said axle; and a means for vacuuming debris from a work surface within said housing.

2. The robotic vacuum of claim 1 further comprising:

one or more counterweights provided within the housing;

an electric servomotor to adjust the positioning of said one or more counterweights;

a gyroscope sensor to calculate the necessary positioning of said one or more counterweights to maintain an upright positioning of said housing.

3. The robotic vacuum of claim 1 wherein said housing may be turned in a left or right direction by adjusting the rotational speed of one wheel relative to that of the other wheel.

4. The robotic vacuum of claim 1 wherein said axle further supports any of: a vacuuming motor, one or more batteries, and a dustbin for storage of collected debris.

5. A laterally-oriented cylindrical housing for a robotic vacuum with one or more openings on the underside thereof for allowing the entrance of debris into said housing comprising:

an axle provided through the center of said housing;

two wheels of diameter larger than the diameter of said housing provided at either end of said axle;

a set of bearings connecting said wheels to said axle; and one or more motors to turn said wheels;

whereby said housing may be driven through a work space by the turning of said set of wheels.

6. The housing for a robotic vacuum of claim 5 further comprising:

one or more counterweights;

an electric servomotor for moving said one or more counterweights;

a gyroscope sensor to calculate counterweight movements necessary to maintain said housing in an upright position.

7. The housing for a robotic vacuum of claim 5 wherein said housing may be turned in a left or right direction by adjusting the rotational speed of one wheel relative to that of the other wheel.

8. The housing for a robotic vacuum of claim 5 wherein said axle further supports any of: a vacuuming motor, one or more batteries, and a dustbin for storage of collected debris.

* * * * *